United States Patent [19]

Summer

[11] 4,002,421

[45] Jan. 11, 1977

[54] CONTROL OF VERTICAL HEAT TREATING VESSELS

[75] Inventor: James R. Summer, Blum, Tex.

[73] Assignee: Round Rock Lime Company, Blum, Tex.

[22] Filed: Mar. 7, 1975

[21] Appl. No.: 556,282

Related U.S. Application Data

[60] Division of Ser. No. 467,139, May 6, 1974, Pat. No. 3,884,621, which is a continuation-in-part of Ser. No. 383,484, July 30, 1973, Pat. No. 3,849,061.

[52] U.S. Cl. ..... 432/19; 432/36; 432/47

[51] Int. Cl.[2] ..... F27D 7/00; F27B 9/40

[58] Field of Search ..... 432/14, 17, 19, 36, 432/47

[56] References Cited

UNITED STATES PATENTS

| | | | |
|---|---|---|---|
| 2,451,024 | 10/1948 | Ellerbeck | 432/17 |
| 2,616,678 | 11/1952 | Grossman | 432/36 X |
| 2,814,479 | 11/1957 | Leone | 432/36 X |
| 3,119,605 | 1/1964 | Berz | 432/47 |
| 3,185,457 | 5/1965 | Boll et al. | 432/36 |

*Primary Examiner*—John J. Camby
*Attorney, Agent, or Firm*—Richards, Harris and Medlock

[57] ABSTRACT

Uniform heat treatment of particulate material of non-uniform gradation in a vertical heat treating vessel such as a vertical kiln or retort is affected by regulating the heat input to a heat treating zone in the vessel in response to changes in specific gravity of the mass of particles passing into the heat treating zone as detected by measurements such as differential pressure changes of combustion supporting fluid and process gas flowing into and from the heat treating zone to result in a balance between particulate mass flow and heat input and substantially uniformly heat treated particulate material. Furthermore, uniform oxygen conversion within a heat treating zone in a vertical heat treating vessel is maintained by measuring the oxygen content in the effluent gases passing from the gas outlet of the heat treating vessel and controlling the flow of air into the heat treating vessel in response to variations of the oxygen content in the effluent stream to maintain a constant oxygen content in the effluent gas stream.

15 Claims, 5 Drawing Figures

CONTROL OF VERTICAL HEAT TREATING VESSELS

This is a division of copending application Ser. No. 467,139 filed May 6, 1974, now U.S. Pat. No. 3,884,621, which is a continuation-in-part of application Ser. No. 383,484 filed July 30, 1973, now U.S. Pat. No. 3,849,061.

This invention relates to vertical heat treating vessels. In another aspect, this invention relates to controlled heat treatment of particulate material within a vertical vessel. In still another aspect, this invention relates to a novel calcining process and apparatus.

Vertical heat treating vessels which are commonly known as vertical kilns, shaft kilns, shaft furnaces, or shaft generators, retorts or the like, depending upon the type of treatment and the material being treated, comprise process equipment commonly found in diverse kinds of industry. Such devices have been used for burning or calcining lime, coking coal, burning argillaceous and calcareous material in the production of cement clinker, burning magnetite, dolomite, retorting oil shale, and the like. Such devices commonly include a vertical vessel having an elongated heating shaft therewithin, a means for uniformly feeding a particulate material into the elongated heating shaft, a lower discharge means for removing material from the lower outlet end of the kiln, and a means for introducing a stream of heat treating fluid through the particulate material. Commonly, these vessels include a means for introducing a combustible fluid such as a fuel-air mixture upwardly through the kiln which establishes a combustion or burning zone in the middle portion of the kiln. Other conventional kilns or retorts utilize a heat supply system which includes an external combustion system and means for directing the hot gases from the combustion system to the burning zone of the kiln.

Problems have been encountered in maintaining a uniform downward movement of particulate material throughout the cross sectional extent of the vertical shaft from the top or feed end of the kiln to the lower or outlet end of the kiln. As a result, discharge grates such as disclosed in U.S. Pat. No. 3,401,922 have been developed in an effort to solve this problem. Furthermore, problems have been encountered in uniformly heat treating the particulate material passing through the kiln, even though the actual speed of the particulate mass passing through the kiln can be fairly accurately controlled by using discharge grate systems such as disclosed in the above-cited patent. In general, uniform heat treatment of a particulate mass passing through a vertical kiln has been difficult to effect because of the difficulty of maintaining the required heat input to the material passing through the burning zone.

It has generally been difficult to obtain a uniform quality of reactive lime (CaO) from limestone ($CaCO_3$) feed material with a vertical kiln. Very reactive lime (which is reactive to water for hydration) is basically in the rhombic crystalline form. Lime in a cubic crystalline form is nonreactive to water for hydration. Limestone generally has a rhombic crystalline structure and by careful control of the calcining process which includes burning of the limestone and removing $CO_2$ therefrom, the rhombic crystalline structure of limestone can be retained in the lime. However, overburn in a kiln will alter the rhombic crystalline structure of the product, e.g., change it to cubic form, and therefore, reduce its chemical activity.

Thus, prior art vertical kilns have not provided precise control of the calcining operation, particularly when run on a continuous basis and when the grade and size of the limestone charge is changed during the run. Since quarried limestone generally has a varying particle size, for example from about ¾ or less to about 2¾ inches or more, it has been extremely difficult to obtain a uniform distribution of solids and treating fluids through the burning zone in the vertical kiln. As a result, the more reactive limes have been produced by the rotary kilns available in the art. The rotary kilns are extremely thermally inefficient but capable of producing a uniformly calcined and active product. Therefore, the lower grade limes are conventionally produced by the vertical kilns. Furthermore, lime produced by prior art vertical kilns can vary widely in product quality, because the gradation of the limestone fed to the kiln generally varies considerably.

Furthermore, control of proper fuel/air ratios within the heat treating or burning zone of vertical heat treating vessel has been generally difficult to accomplish because of such factors as (1) leakage of air and/or vaporous fuel such as natural gas through the particulate outlet which removes the heat treated particulate material from the lower end of the vertical vessel; and (2) changes in atmospheric conditions which effect the quantity of gas and air which is fed to the heat treating zone. More specifically, changes in atmospheric temperature and pressure will substantially affect the number of molar equivalents of natural gas and oxygen which is contained within a metered volume of natural gas or air which is passed into the heat treating zone. Consequently, the use of conventional controls for metering these gaseous fluids to the interior of the kiln generally inadequately compensates for atmospheric changes.

According to one embodiment of the subject invention, a uniformly controlled oxygen conversion within a fluid comprising a combustion supporting gas and air is provided within a heat treating zone of a vertical vessel by constantly measuring the oxygen content of effluent gases passing from the burning zone and controlling the relative amount of air passed to the burning zone in response to variations in the oxygen content in the effluent gas stream to thereby maintain a relatively constant oxygen content in the effluent stream.

According to another embodiment of the subject invention, a method and apparatus are provided for heat treating particulate material of nonuniform gradation in a vertical kiln by supplying a heat input within a combustion stream comprising gaseous fuel and air which is passed through a heat treating zone of the vertical vessel, which heat input is sufficient to treat a charge of average particles which has a predetermined mass residence time as the charge flows by gravity through the heat treating zone which predetermined mass residence time is based upon a predetermined bulk density and a predetermined flow rate of particles through the burning zone and thereafter passing the particulate material through the heat treating zone and sensing a quality indicative of the bulk density of the particulate materials passing through the heat treating zone and comparing the indicated bulk density with the said predetermined bulk density and thereafter controlling one of (1) the flow of particulate material through the heat treating zone and (2) the heat content of fluid passed to the heat treating zone, relative to the compared bulk density to yield a product which has been heat treated equivalent to a charge of standard particles having a predetermined bulk density while constantly sensing the oxygen content of the gaseous effluent from the heat treating zone and controlling the flow of at least one of (1) air and (2) gaseous fuel to the heat treating zone in response to variations in the said oxygen content to maintain a substantially uniform oxygen content in the effluent stream.

According to still another embodiment of the subject invention, particulate materials of a nonuniform gradation are heat treated in a heat treating zone of a vertical vessel by regulating the heat input to the heat treating zone in the vertical vessel in response to differential pressure changes a fluid, such as combustion supporting fluid and process gas flowing into and from the heat treating zone to thereby yield a balance between particulate mass flow and heat input to produce a uniformly heat treated product.

According to still another embodiment of the subject invention, a method and apparatus are provided for heat treating particulate material of nonuniform gradation in a vertical vessel by supplying a heat input to a heat treating zone of the vertical vessel sufficient to treat a charge of average particles which have a predetermined mass residence time in the burning zone which is based upon a predetermined bulk density and a predetermined flow rate of particles through the burning zone and thereafter, passing the particulate materials into the burning zone and sensing a quality indicative of the bulk density of the particulate materials passing through the burning zone and comparing the indicated bulk density with said predetermined bulk density and thereafter controlling the heat content of the heat treating fluid passed to the burning zone relative to the compared bulk density to yield a substantially uniform heat treatment of the particulate material.

According to a specifically preferred embodiment of said above-recited embodiment, the difference in pressure of a fluid passed through the burning zone is measured at a point when the fluid enters the burning zone and a point when the fluid leaves the burning zone and the measured pressure differential is compared to a predetermined pressure differential of the fluid flowing through a mass of average particles having a predetermined mass residence time and a resultant heat treated quality and thereafter the heat input to the heat burning zone is adjusted to yield a substantially uniformly heat treated product having said heat treated quality.

This invention can be more easily understood from a study of the drawings in which.

Figure 1:
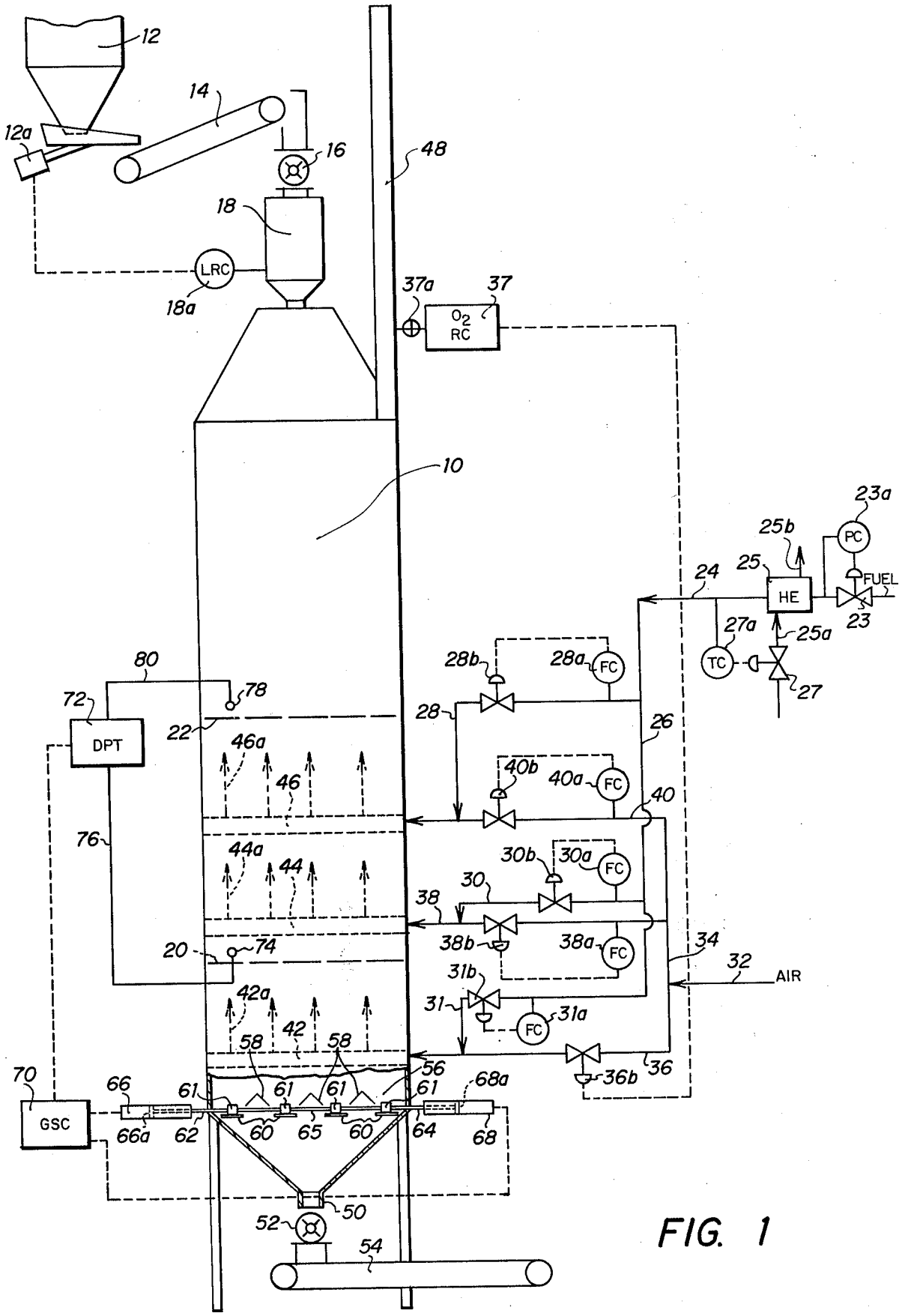
FIG. 1 is a schematic illustration of a vertical kiln equipped with a control mechanism of the subject invention.

Now referring to the drawings, and in particular to FIG. 1, vertical kiln 10 comprises a conventional vertical kiln having an internal hollow shaft within which particulate material is subjected to heat treatment. The inlet to kiln 10 receives solid particulate material such as limestone, which is initially delivered from stone storage bin 12 by way of a conveyor 14 through rotary seal 16 into hopper 18. Level controller **18*a* operates discharge control mechanism 12*a* of storage bin 12.**

Vertical kiln 10 is provided with a fuel and air delivery system adjacent its lower midportion for delivering a combustible mixture to the burning zone of the kiln. The lower end 20 of the burning zone is schematically depicted by a broken line and the upper end 22 of the burning zone is schematically depicted by a broken line.

It is noted that a vertical kiln equipped with the control mechanism of the subject invention can utilize any heat supply system known in the art, e.g., external or internal combustion chambers. As illustrated in this embodiment, a gaseous fuel such as natural gas is delivered by gas inlet conduit 24 and feeds a manifold 26 from which gas supply lines 28, 30 and 31 depend. Gas inlet conduit 24 has flow control valve 23 and heat exchanger 25 operatively positioned therein. Valve 23 is operated by pressure controller **23*a* to assure a constant gas delivery pressure to manifold 26. Heat exchanger 25 receives a heat exchange fluid such as steam or a hot process gas such as kiln waste heat stream through conduit 25*a*, indirect heat exchange contact is made with the gas passing through conduit 24 and then heat exchange fluid is passed from heat exchanger 25 via conduit 25*b*. Valve 27 is operatively positioned within conduit 25*a* and is controlled by temperature controller 27*a* to assure that a uniform quantity of heat is passed to heat exchanger 25 in the heat exchange fluid. Flow controllers 23*a*, 30*a* and 31*a* operate flow control valves 28*b*, 30*b* and 31*b* in gas supply lines 28, 30 and 31, respectively. Air under pressure is supplied from conduit 32 into air manifold 34 from which air lines 36, 38 and 40 emerge. Flow controllers 38*a* and 40*a* operate flow control valves 38*b* and 40*b* in air lines 38 and 40, respectively. Valve 36*b* is operated by oxygen controller 37.**

As shown, gas supply line 28 communicates between air supply line 40 and fuel manifold 26, gas supply line 30 communicates between air supply line 38 and fuel manifold 26, and gas supply line 31 communicates between air supply line 36 and fuel manifold 26. Thus, the gas and air are mixed within air lines 38 and 40 and 36, if desired prior to entrance into the kiln. The fluid from lines 36, 38 and 40 are passed into fluid distributor systems 42, 44 and 46, respectively, before being introduced as distributed streams as illustrated schematically by flow arrows **42*a*, 44*a*, and 46*a***, respectively. Suitable such fluid distributor systems are disclosed in U.S. Pat. Nos. 3,432,348 or 3,589,611, which systems are herein incorporated by reference into this specification. The preferred such system is disclosed in U.S. Pat. No. 3,589,611.

The combustion supporting gas which is delivered by these fluid distributor systems, will provide fuel for the burning zone in the kiln, and allow proper heat treatment of the particulate material passing downwardly therethrough by gravitational force. The off-gases from the kiln are removed via stack 48.

Oxygen controller 37 is connected to an oxygen sensing and transmitting leg **37*a* which operatively communicates with the interior of stack 48 to sense the quantity of oxygen within the effluent gas passing therethrough and provide an input to oxygen controller 37. The input to oxygen controller 37 is compared to its set point to product an output for control valve 36***b* as illustrated in FIG. 1. Any suitable oxygen sensor and transmitter and controller known in the art can be utilized in the scope of this invention. Suitable such oxygen sensors, transmitters and controller which can be used in the scope of the subject invention comprises a 7,803 thermal magnetic oxygen analyzer positioned within stack 48 and attached to a 1991-30-0133 milliwatt transmitter for furnishing inputs to a 420-10-2-1205-10-1-1-100 controller. The output of the controller can pass through a 10970-2 electro pneumatic converter and then to pneumatic valve 366, for example. All of these control compartments are available from Leeds and Northrup Co., Sunneytown Pike, North Wales, Pa.

The heat treated particulate material is passed from outlet 50 through rotary seal 52 onto product conveyor 54. The flow of particulate material to outlet 50 is controlled by a grate control mechanism which operates in accordance with the subject invention. The grate control mechanism will be described in detail below. Grate 56 can be the linear grate for shaft kilns which is disclosed in U.S. Pat. No. 3,401,922 which patent is herein incorporated by reference into this specification. However, any other suitable grate known in the art can be used in the scope of this invention. Grate 56 basically comprises a series of spaced diverter plates 58, having retarder plates 60 positioned a spaced distance below the opening between adjacent diverter plates 58. Generally, the distance of the edge of each retarder plate 60 under each diverter plate 58 is determined by the angle of repose of the material on itself, which passes through the kiln. Pusher bars 61 are reciprocally mounted between diverter plates 58 and retarder plates 60. As illustrated in the embodiment shown in the drawing, half of the pusher bars 61 are interconnected by rods 62 and the other half are interconnected by rods 64. Rods 62 and 64 are connected by rods 65 and are controlled by the action of hydraulic cylinders 66 and 68, respectively. More specifically, rods 62, 64 and 65 move pusher bars 61 in reciprocal motion by the action of hydraulic cylinders 66 and 68, respectively. In essence, the controlled reciprocal movement of pusher bars 61 across retarder plates 60 controls the flow of material passing to the outlet 50 from openings between adjacent diverter plates 58.

The relative motion imparted to rods 62 and 64 by hydraulic cylinders 66 and 68, respectively, is regulated by grate speed controller 70. Grate speed controller 70 in turn is operatively connected to differential pressure transmitter 72. Pressure sensor 74 is positioned adjacent the lower end 20 of the burning zone within the kiln and is operatively connected to differential pressure transmitter 72 via line 76. Pressure sensor 78 is positioned at a point adjacent the upper end 22 of the burning zone within the kiln 10 and is operatively connected to differential pressure transmitter 72 via line 80.

Figure 2:
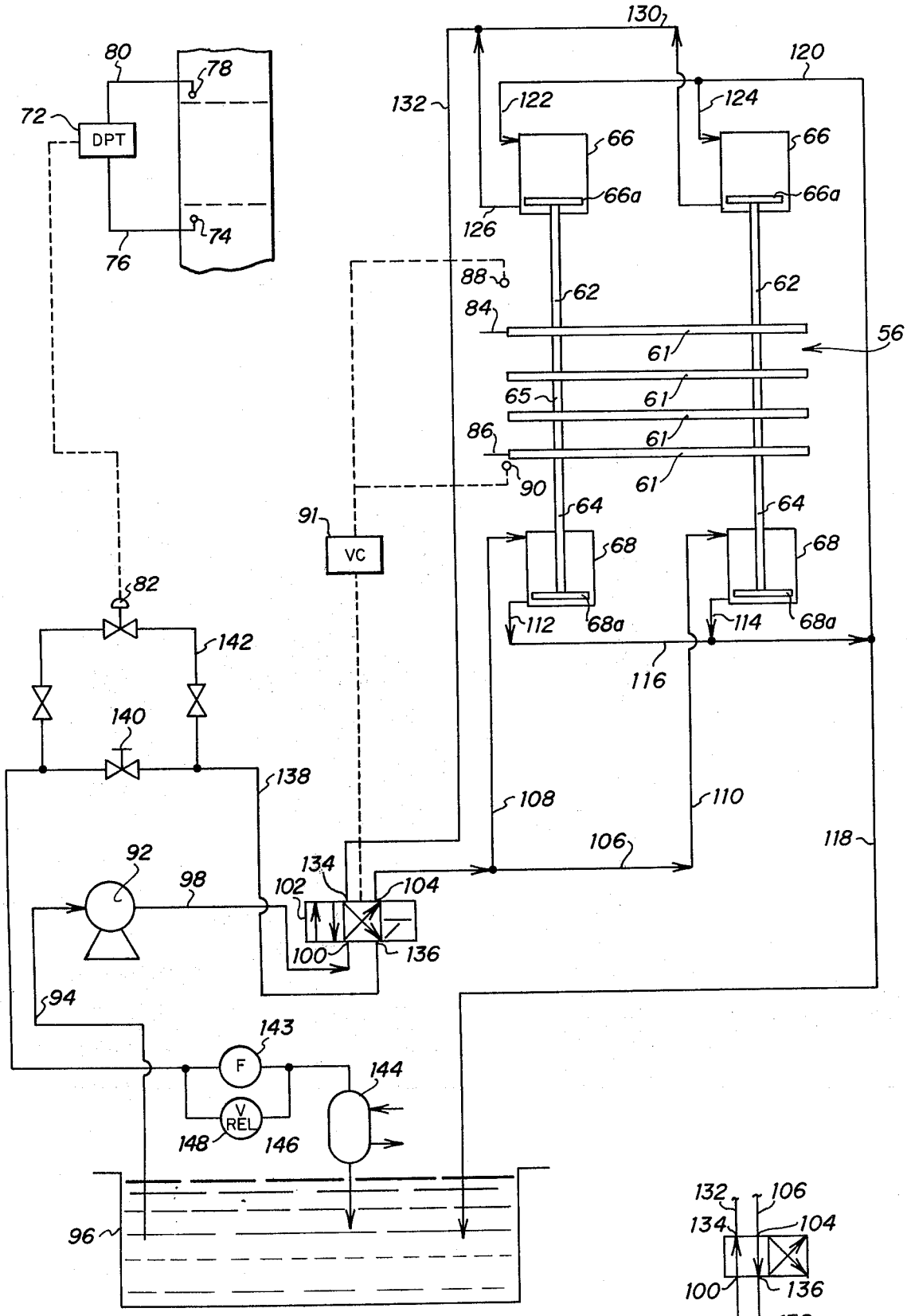
FIG. 2 is a schematic diagram showing the control mechanism of FIG. 1 in greater detail.

A detailed view of a preferred control system used in the scope of the subject invention is schematically illustrated in FIG. 2. As shown, differential pressure transmitter 72 can comprise any suitable type differential pressure transmitter known in the art having two signal inputs and one signal output. A suitable such device is Honeywell $\Delta p/P$ transmitter Model 29212-01-0-1. Thus, differential pressure transmitter 72 receives two pressure inputs from pressure sensors 74 and 78, compares these inputs, and transmits a signal representative of the difference of the two to control valve 82. It is noted that the combination of pressure sensor 78 and line 80 and the combination of pressure sensor 74 and line 76 can each comprise a monometer tube. In this instance, it is desirable to pass a uniform flow of purge gas such as air through the monometer tubes. It is furthermore noted that pressure sensing means 74 and 78 can be positioned at any convenient spaced distance below and above, respectively, the burning zone in the kiln. However, it is generally preferred that pressure sensor 74 be positioned adjacent the lower end of the burning zone and that sensor 78 be positioned adjacent the upper end of the burning zone within kiln 10.

Now again referring to FIG. 2, the pistons 66*a* within hydraulic cylinders 66 are coupled to rods 62, and rods 62 carry pusher bars 61. Likewise, the pistons 68*a* within hydraulic cylinders 68 are operatively connected to rods 64, and rods 64 carry pusher bars 61. Rods 62 and 64 are interconnected by rods 65. Switch bars 84 and 86 depend from pusher bars 61 and function, as shown, to actuate contacts 88 and 90, respectively. contacts 88 and 90 actuate a conventional valve control switch 91 which functions to alternately move four-way valve 102 between its first and second positions.

The hydraulic system which is utilized to operate grate 56 includes a centrifugal pump 92 with an inlet conduit 94 operatively communicating between hydraulic fluid reservoir 96 and the inlet of pump 92. Conduit 98 communicates between the outlet of pump 92 and port 100 of four-way valve 102. Four-way valve 102 can be any conventional four-way valve unit known in the art. A suitable such four-way valve is a Racine Model No. OD4-DNHS-102S. As shown in FIG. 2, four-way valve 102 is in its first position, which will thereby allow port 100 to communicate with port 104. Manifold conduit 106 operatively communicates with port 104. Conduits 108 and 110 operatively communicate between manifold conduit 106 and the front faces of the pistons 68*a* within hydraulic cylinders 68. Conduits 112 and 114 communicate between the rear faces of pistons 68*a* within hydraulic cylinders and conduit 116. Conduit 116 operatively communicates with outlet manifold conduit 118. Outlet manifold conduit 118 communicates between hydraulic fluid reservoir 96 and conduit 120. Conduits 122 and 124 operatively communicate between conduit 120 and the rear faces of pistons 66*a* within hydraulic cylinders 66. Conduits 126 and 128 communicate between the front faces of pistons 66*a* within hydraulic cylinders 66 and conduit 130. Conduit 132 communicates between valve port 134 of four-way valve 102 and conduit 130. As shown, with four-way valve 102 in its first position, valve port 134 communicates with valve port 136 and valve port 136 operatively communicates with conduit 138. Flow control valve 140 is positioned within conduit 138 and conduit 142 comprises a by-pass loop communicating with conduit 138 on either side of flow control valve 140. Flow control valve 140 can be any conventional such valve known in the art. A suitable such valve is a constant volume, temperature and pressure compensated flow control valve such as a Racine Model F2-AHS *-02* valve. Control valve 82 is positioned within conduit 142.

As previously set forth, control valve 82 is operated by signals from differential pressure transmitter 72 and can comprise any suitable control valve mechanism known in the art. For example, control valve 82 can comprise a Black, Sivalls, and Bryan Valve Operator type 70-13-10 and a Racine Model OF2-CHPW-50H hydraulic valve. Conduit 138 communicates from conduit 142 to hydraulic fluid reservoir 96. A filter 143 and a heat exchanger 144 are operatively positioned within conduit 138. In addition, by-pass conduit 146 is positioned around filter 143 with relief valve 148 positioned therein which will allow hydraulic fluid to by-pass the filter when a predetermined hydraulic pressure is reached, e.g., in case of pressure surges or in instances wherein the filter becomes clogged.

Now, referring to FIGS. 1–3, the operation of the control apparatus of the subject invention will be described in detail. Basically, the control apparatus as set forth in the drawing functions to control the heat treatment of particulate-materials passing through vertical kiln 10 and assures a predetermined mass residence time within vertical kiln 10. Generally, particulate material which is fed to the vertical kiln 10 will vary in particle size and in gradation of the particles and accordingly, will vary in mass density.

Generally, particulate material such as previously crushed and sized limestone delivered from storage bin 12 into hopper 18 on kiln 10 will have a mass density which varies from a fixed minimum to a fixed maximum. However, due to the fact that the particulate material is subjected to gravitation action not only within storage bin 12, but also within the interior of feeder hopper 18 and vertical kiln 10, the particle size gradation will not be constant. Therefore, in accordance with a preferred embodiment of this invention, the grate speed of controller 70 is calibrated by passing the crushed and sized particulate material, such as limestone, through the kiln having a relative constant heat input to the burning zone, and controlling the grate speed until a product having the desired degree of calcination is obtained, e.g., a product wherein the carbon dioxide content of the calcined limestone falls within the range of from ±2 weight percent of a control value, such as 3 or 3.5 wt. percent of the product. The calibration of the grate speed and differential pressure is basically linear in nature, and it is found that to obtain a product of the desired quality with the material having the nonuniform gradation that a substantially uniform mass residence time will pass through the burning zone. Thus, the term "substantially uniform mass residence time" is herein meant to include a mass residence time which will yield a product having the predetermined or controlled degree of calcination when passed through the burning zone (a degree of calcination which falls within a desired range).

Generally, a relatively constant heat input is supplied to the burning zone in vertical kiln 10. This constant heat input is based upon an average or predetermined particle gradation and consequently, an average or predetermined mass density of particulate material which is passed through the heating zone to assure that proper heat treatment of the particulate material is effected without resulting in either overburn or underburn of the material as described above. The material of the predetermined mass density will effect a predetermined pressure drop of fluid passing through the burning zone, e.g., the air and fuel mixture and process gases released by calcination and gaseous combustion products of the mixture which is passed upwardly through kiln 10 from fluid distributor systems 42, 44 and 46. Thus, valve 140 is set at a predetermined opening and functions in combination with control valve 82 to control the amount of hydraulic fluid passing through conduit 138 and thereby controls the speed of grate 56. When material enters the burning zone which has either higher or lower porosity than the standard material of predetermined particle gradation (i.e., has a higher or lower mass density) differential pressure of the fluid passing upwardly through the burning zone will accordingly be altered and the differential pressure input to control valve 82 will adjust control valve 82 which in turn adjusts flow through conduit 138 and alters the speed of gate 56. Thus, valve 82 is calibrated to control the speed of grate 56 in response to variations of differential pressure outputs from differential pressure transmitter 72. In essence, if material enters the burning zone of the kiln which has a greater mass density and thereby lower porosity than the predetermined or average mass density, differential pressure transmitter 72 will indicate an increase in differential pressure between the lower and upper portion of the burning zone. This will effect a closure of valve 82 and a slowing down of grate 56 which will allow a longer burning time for the higher mass density material entering the zone such that the material will have an equivalent mass residence time to that of the material with the predetermined mass density and thereby yield a substantially uniform calcined product. Alternately, if the material entering the burning zone has a lower mass density and therefore a greater porosity than the material of predetermined particle size, then the differential pressure between the upper and lower portions of the burning zone will be less than that which corresponds to the material of predetermined particle size and the differential pressure transmitter will effect an opening of control valve 82, and thereby allow grate 56 to operate at a faster rate so that the resulting mass residence time of the higher porosity lower mass density material is equivalent to that of the material of predetermined particle size and again yield a substantially uniform calcined product.

Figure 3:
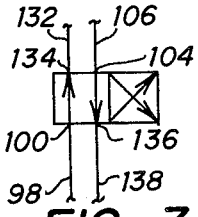
FIG. 3 is a partial view of FIG. 2 showing the four-way valve in its second position.

Referring to FIGS. 2 and 3, the operation of grate 56 will be discussed in detail. Initially, valve 140 is adjusted so that the flow of fluid therethrough in combination with the flow of fluid through valve 82 will result in a grate speed which is sufficient to yield a predetermined mass residence time of particulate material of predetermined particle size passing through the burning zone of kiln 10. Now, with four-way valve 102 in its first position as illustrated in FIG. 2, pump 92 is run at a constant speed and constantly withdraws hydraulic fluid from reservoir 96 via conduit 94 and passes the hydraulic fluid to port 100 of four-way valve 102 via conduit 98. The fluid passes through four-way valve 102, port 104, and into conduit 106 and conduits 108 and 110, thereby passing fluid into the front portion of hydraulic cylinders 68 and against the front faces of pistons **68*a* therewithin. This causes a retraction of pusher rods 64 and a movement of retarder plates 60. Since pusher rods 64 are interconnected to rods 62 by rods 65, this also causes an extension of rods 62 and results in the front faces of piston 66*a* of hydraulic cylinder 66 forcing fluid to conduit 130 via conduits 126 and 128. Furthermore, the retraction of pistons 68*a* causes fluid to pass through conduits 112 and 114 to outlet manifold conduit 118 and into conduits 120, 122, 124 and also into reservoir 96. Fluid from conduit 130 passes to conduit 132 into valve port 134 through four-way valve 102 to valve port 136 and into conduit 138.**

The fluid passes through conduit 138, through conduit 142, control valve 82, valve 140, through filter 143, heat exchanger 144, wherein the fluid is cooled and back to reservoir 96. This action continues until switch bar 86 touches contact 90. When contact 90 is actuated, valve control switch 91 moves four-way valve 102 to its second position as illustrated by the partial view in FIG. 3. In this instance, the pump output flowing through conduit 98 to valve port 100 passes directly to valve port 134 into conduits 132, 130 and 126 and 128 to the front face of pistons 66*a* and hydraulic cylinders 66. This action causes pistons 66*a* to retract, and rods 62, pusher bars 61 and rods 64 to be moved toward hydraulic cylinders 66. This action causes fluid against the rear face of piston 66*a* to pass through conduits 122, 124 and to conduits 120, and 118, 114, 112 to the rear faces of pistons 68*a* of hydraulic cylinders 68. This in turn will force fluid which is in contact with the front faces of pistons 68*a* of hydraulic cylinders 68 into conduits 108, 110, 106, into valve port 104 of four-way valve 102.

The fluid passes through four-way valve 102 to valve port 136 into conduit 138 and again through conduit 142, control valve 82, filter 143, heat exchanger 144, back to the reservoir 96. This action continues until switch bar 84 actuates contact 88 which in turn actuates valve control switch 91 which moves four-way valve 102 again to its first position, at which time the sequence is repeated. As can be seen, changes from the differential pressure transmitter 72 alter the opening of valve 82, and thereby controls the speed of grate mechanism 56. More specifically, when four-way valve 102 is in its first position and fluid from centrifugal pump 92 is being pumped against the front faces of pistons 68*a* within hydraulic cylinders 68 and thereby causing them to retract within the hydraulic cylinders 68, rods 62 are extending from hydraulic cylinders 66 and thereby, the front faces of pistons 66*a* within hydraulic cylinders 66 are forcing fluid through the outlet flow path toward reservoir 96 which includes a passage through valves 140 and control valve 82. Thus, the back pressure imparted on the system by an opening or closing of control valve 82 will affect the speed at which the fluid from the centrifugal pump 92 will move pistons 68*a* and 66*a*.

It has been found that the above-described operation of a vertical heat treating vessel such as a vertical kiln functions efficiently under ideal conditions. However, it has been found in actual operation that the supply of a constant heat input to the interior of the burning zone is quite difficult. Two conditions exist which contribute to these difficulties. The first is variable degrees of air loss through rotary seal 52 and the second is the inability of the volumetric air and gas controls to maintain a constant gravimetric flow of natural gas and air with varying atmospheric conditions. It is necessary in the heat treatment of particulate materials such as limestone, or oil shale that a predetermined well regulated heat input be maintained within the burning zone and that excess air be closely controlled. In essence, the maximum quantity of free or unconverted oxygen in the burning zone should be controlled to very close tolerances. Therefore, in accordance with a preferred embodiment of the subject invention, an apparatus and process is provided which will assure a uniform heat treatment of particulate material in a heat treating zone wherein the heat input is maintained within desired limits and excess oxygen beyond the limit that would deleteriously affect the process is eliminated from the burning zone. More specifically, referring to FIG. 1, the oxygen sensing and transmitting leg 37*a* is positioned within stack 48 and determines the quantity of oxygen within the effluent gases passing from the burning zone within kiln 10. A signal indicating the sensed oxygen content within the effluent gases is transmitted via oxygen sensing and transmitting leg 37*a* to oxygen controller 37 wherein it is compared with a set point which corresponds to the desired content or oxygen within the effluent stream. Oxygen controller 37 then generates a signal which is transmitted to valve 36*b* to control the relative amount of air passing into the burning zone of kiln 10. Thus, when the oxygen sensing and transmitting leg 37*a* indicates that too much oxygen is present within the effluent gases, the signal passed to valve 36*b* results in a proportional closing of valve 36*b*. This occurs until the desired level of oxygen is maintained within the effluent gases passing through stack 48. Alternately, when the oxygen analyzer indicates that a desired minimum quantity of oxygen is not contained within the effluent gas passing through stack 48, the signal passing from oxygen controller 37 will result in an opening of valve 36*b* until the desired oxygen content is maintained within the effluent gases passing through stack 48. The desired level of oxygen within the effluent gases will vary in accordance with the process. In most processes, it is generally desirable to maintain between 1 and 2% oxygen in the effluent gas to assure efficient utilization of the fuel and yet prevent an excess quantity of oxygen within the burning zone which can yield deleterious results.

It is also noted that in accordance with this embodiment, it is desirable to pre-heat the fuel stream which passes to manifold 26 in a manner as shown in FIG. 1. As explained above, the fuel passes to manifold 26 at a constant pressure by the action of valve 23 and pressure controller 23*a*. Furthermore, the heat exchanger 25 by the cooperation of valve 27 and temperature controller 27*a* will assure that the fuel is preheated to a constant temperature. In this manner, a known volume of fuel metered into manifold 26 will always contain a known molar quantity of combustible material. Therefore, the relative control of the air to this known quantity of gas assures that with varying atmospheric conditions, a known heat input will be passed to the interior of the kiln. It is also noted that it is within the scope of this invention to connect oxygen controller 37 to valves which control both the flow of the fuel stream and air stream or to valves which control only the fuel stream or the air stream. However, it is generally preferable to operate valve 36*b* in a manner schematically illustrated in FIG. 1 and discussed above.

It is noted that the above embodiments disclosed in FIGS. 1–3 maintain a uniform heat treatment of particulate material passing through the heating zone in a kiln by varying the rate at which the particulate material passes through the burning zone in relation to the specific gravity of the mass passing to the burning zone, and also by maintaining a uniform oxygen content within the burning zone. It is also within the scope of the subject invention to vary the heat input to the burning zone of a vertical kiln in response to changes in the specific gravity of the mass of material flowing through the burning zone. Specific embodiments of this aspect are illustrated in FIGS. 4 and 5.

Figure 4:
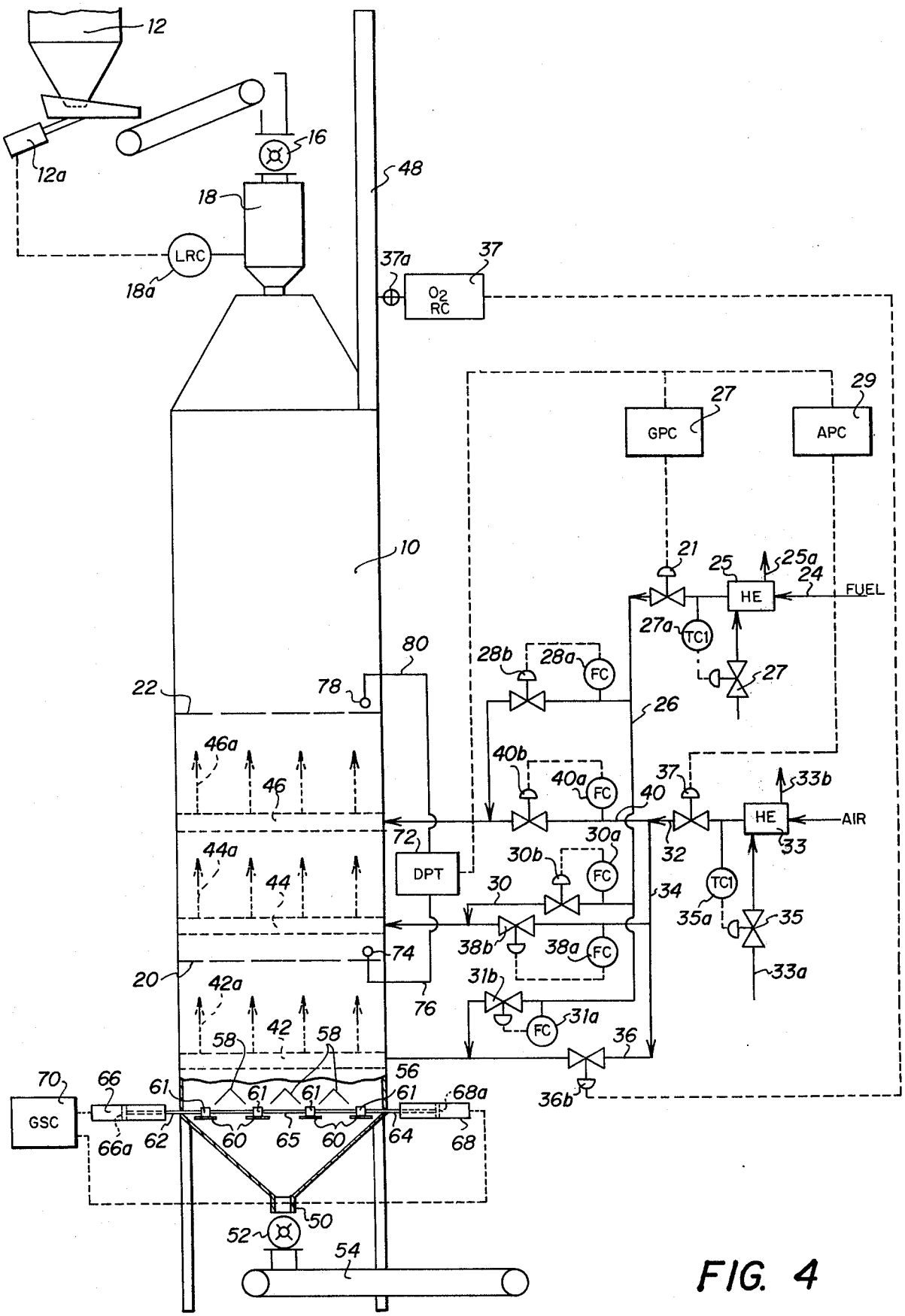
FIG. 4 is a schematic illustration of a vertical kiln equipped with control mechanisms in accordance with a preferred embodiment of the subject invention.
Figure 5:
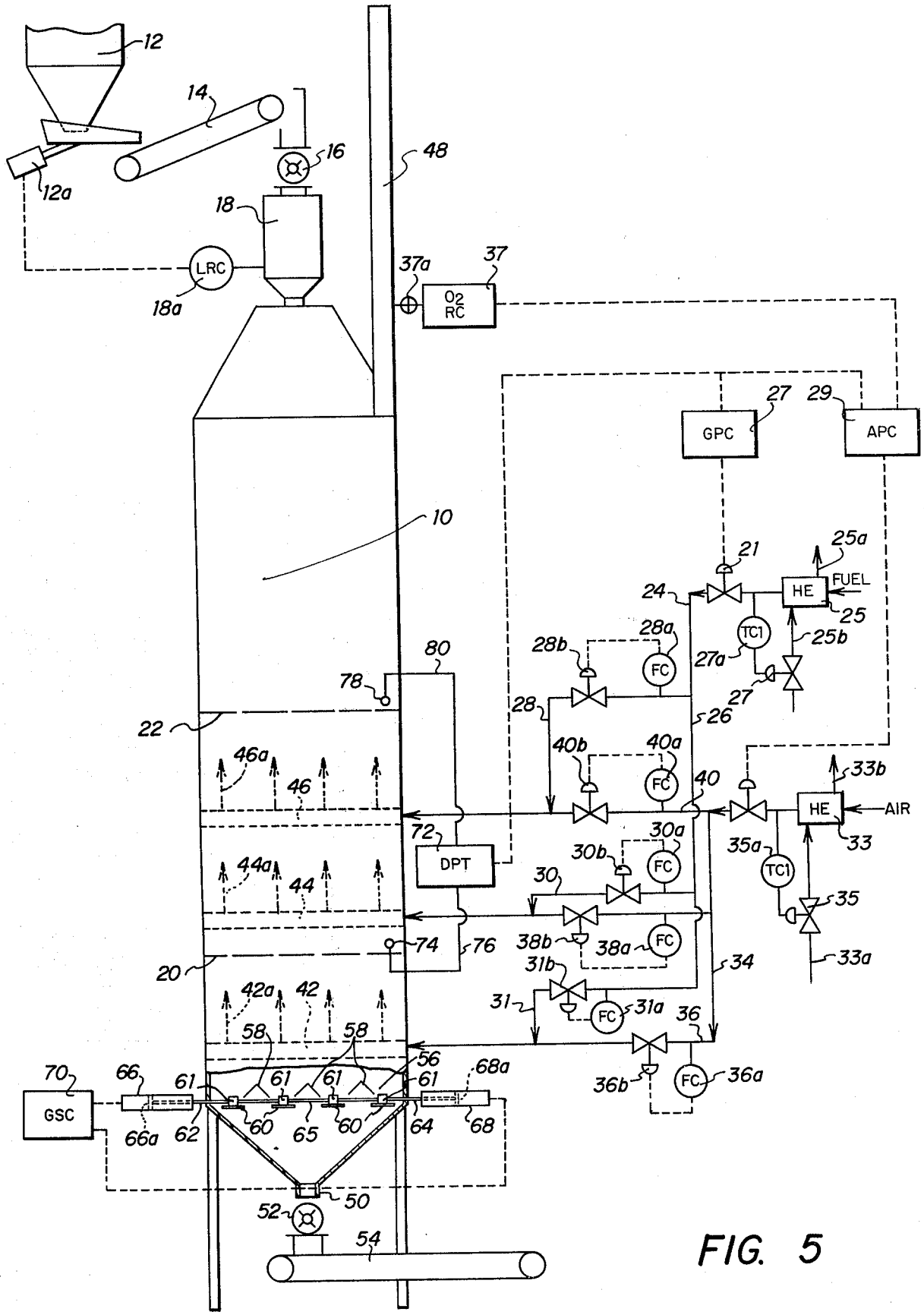
FIG. 5 is a schematic illustration of a vertical kiln showing still another embodiment of the subject invention.

Now referring to FIG. 4, a control mechanism for kiln 10 is schematically illustrated in accordance with a preferred embodiment of the subject invention whereby the heat input to a heat treating zone in kiln 10 is controlled in response to differential pressure fluctuations of the combustion-supporting fluid and process gases flowing upwardly through the heat treating zone in the kiln. In FIG. 4, many of the components are the same as that illustrated in FIGS. 1–3 and the same components are designated by the same characters as shown in FIGS. 1–3. The basic changes in the controls are set forth below.

Level controller 18*a* is operatively connected to discharge control mechanism 12*a*. Differential pressure control legs 76 and 80 are positioned below and above the burning zone, respectively, within kiln 10 in a manner as described in relation to FIG. 1. However, the output of differential pressure transmitter is operatively connected to gas pressure controller 27 and air pressure controller 29 as shown schematically in FIG. 4. Grate speed controller 70 is set to operate at a constant speed which is equivalent to uniformly withdraw particulate materials having an average or predetermined mass density. Gas pressure controller 27 and air pressure controller 29 can be any conventional valve controllers known in the art. The output of gas pressure controller 27 is operatively connected to pressure control valve 21 which in turn is operatively positioned within fuel conduit 24. Likewise, the output of air pressure controller 29 is operatively connected to pressure control valve 37 which is operatively positioned within air supply conduit 32. Furthermore, heat exchanger 33 is operatively connected to air supply conduit 32. A heat exchange fluid such as steam or waste heat stream such as a kiln waste heat stream is passed to the heat exchange fluid inlet of heat exchanger 33 via conduit 33*a*, passed in indirect contact with the air flowing through conduit 32 and then removed from heat exchanger 33 via outlet conduit 33*b*. The quantity of heat exchange fluid which passes through conduit 33*a* is controlled by valve 35 which in turn is controlled by temperature controller 35*a* which senses the temperature within conduit 32. Alternately, steam can be passed directly into the air stream passing through conduit 32 to provide not only heat but a controlled amount of moisture therein.

In operation of the embodiment set forth in FIG. 4, particulate material such as previously crushed and sized limestone is delivered from storage bin 12 into hopper 18 at a generally uniform rate based on the weight of the limestone. However, this material will have a mass density which varies from a fixed minimum to a fixed maximum. Furthermore, due to the fact that the particulate material is subjected to gravitation action not only within storage bin 12 but also within the interior of feeder hopper 18 in vertical kiln 10, the particulate size gradation will not be constant. Initially, a relatively constant heat input is supplied to the burning zone in vertical kiln 10 based upon an "average" or predetermined particle gradation and consequently an average or predetermined mass density of particulate material which is passed through the heating zone. Grate speed controller 70 controls the speed of grate 56 at a constant speed sufficient to withdraw a relatively constant volumetric amount of the particulate material having the average or predetermined mass density which is fed to kiln 10. The fuel passes through conduit 24 into fuel manifold 26 and is preheated to a constant temperature in heat exchanger 25 and maintained at a predetermined pressure by valve 21. Likewise, air is passed through heat exchanger 33, control valve 32 and into air manifold 34. The relative quantity of fuel-air is set to maintain a predetermined heat input based upon the average or predetermined mass density of particulate material which passes through kiln 10.

However, when material enters the burning zone which has either a higher or lower porosity than the standard material or predetermined particle gradation (i.e., has a higher or lower mass density), the differential pressure of the fluid passing upwardly through the burning zone which is measured by differential pressure transmitter 72 is accordingly altered and a differential pressure input to gas pressure controller 27 and air pressure controller 29 will result in outputs from gas pressure controller 27 and air pressure controller 29 proportionally altering the quantity of gas and air which passes through valves 21 and 37, respectively. Thus, each input from differential pressure transmitter 72 is compared with set points within controllers 27 and 29, respectively, to effect an alteration of the outputs of the controllers 27 and 29 to the valves 21 and 37 and either decrease or increase the heat input passing into the burning zone. More specifically, if material enters the burning zone of the kiln which has a greater mass density and thereby a lower porosity than the predetermined or average mass density, differential pressure transmitter 72 will indicate an increase in differential pressure between lower and upper portion of the burning zone. This signal is transmitted to gas pressure controller 27 and air pressure controller 29 and will effect a proportional opening of valves 21 and 37, respectively, to thereby increase the heat input of the combustion supporting stream passing from fluid distributors 42, 44 and 46. Since grate 56 is withdrawing particulate material from the lower portion of the kiln at a relatively constant volumetric rate, the increase in heat content of the heating fluid passed to the interior of kiln 10 results in the particulate material passing through the heating zone having an equivalent heat treatment to that of the material with a predetermined mass density. This results in a substantially uniform heat treated product. Alternately, if the material entering the burning zone has a lower mass density and therefore a greater porosity than the material of predetermined particle size, then the differential pressure between the upper and lower portions of the burning zone will be less than that which corresponds to the material of predetermined particle size and the differential pressure transmitter 72 will transmit signals to gas pressure controller 27 and air pressure controller 29 which when compared to the set points in these controllers results in outputs from these controllers to valves 21 and 37, respectively, which will effect a proportionate closing of the valves so that a proportionally lower heat input will be contained within the fluid passing from fluid distributors 42, 44 and 46. The material passing through the burning zone will have equivalent heat treatment to that of the material of predetermined particle size.

Furthermore, during the above operation, oxygen-sensing probe 37*a* is constantly sensing the oxygen content within the effluent gases passing through stack 48 and passing a signal to oxygen controller 37. The output of oxygen controller 37 which is the result of the compared sensed oxygen input and the set point of the controller will effect either an opening or a closing of valve 36*b* positioned within air line 36 to assure that effluent gases passing through stack 48 will have a predetermined oxygen content and furthermore to assure that excess oxygen will not be contained within the fluid passing to the burning zone in the kiln.

Now referring to FIG. 5, a variation of the embodiment set forth in FIG. 4 is schematically illustrated. Basically, all components in the embodiment shown in FIG. 5 are the same except that the output from oxygen controller 37 forms an input to air pressure controller 29 and the valve 36*b* is controlled by a flow controller 36*a*. The operation of the embodiment set forth in FIG. 5 is the same as that set forth in FIG. 4 except that the output from oxygen controller 37 controls the set point to air pressure controller 29 such that the output from air pressure controller 29 inherently contains an adjustment to assure that a constant oxygen content is maintained within the effluent gases which pass the step 48.

It is noted that the embodiments as illustrated in FIGS. 4 and 5 can be utilized in various types of heat treating vessels to control one or more heat treating zones. For example, in the retorting of oil shale it is desirable to pass the oil shale downwardly through the vertical shaft and expose it to at least two heat treating temperatures. The control mechanisms schematically illustrated in FIGS. 4 and 5 can be utilized to control the heat input to such heat treatment zones.

The following examples are given to better facilitate the understanding of this invention and are not intended to limit the scope thereof:

Example 1

An apparatus such as illustrated in FIGS. 1–3 was utilized to calcine limestone. The crushed and sized limestone which was calcined generally had a particle size ranging from about ¾ to about 2¾ inches. The gradation of the limestone varied substantially but it generally had a mass density in the range of from about 76 to about 86 pounds per cubic foot. Due to the tendency of the smaller particles to gravitate downwardly within storage bin 12 and kiln 10, the gradation of the limestone passing through the burning zone of kiln 10 will vary considerably with time. As an example, limestone which had a mass density ranging from about 76 to about 86 pounds per cubic foot and which was delivered from storage bin 12 over a period of 8 days was measured for particle size distribution two or three times a day and the results are shown in Table I below.

Table I

| | | STONE GRADATION % Retained on Screed | | | | |
|---|---|---|---|---|---|---|
| Day | Time | 1-½" | 1" | ¾" | ½" | 0 |
| 1 | 0900 | 44.7 | 32.4 | 15.4 | 5.2 | 2.3 |
| | 1700 | 19.7 | 33.0 | 25.0 | 20.2 | 2.1 |
| 2 | 0100 | 20.2 | 25.7 | 20.5 | 13.9 | 19.7 |
| | 1700 | 60.1 | 28.1 | 5.4 | 4.9 | 1.5 |
| 3 | 0100 | 18.6 | 61.7 | 18.1 | 1.6 | 0 |
| | 0900 | 47.5 | 32.5 | 10.0 | 4.5 | 5.5 |
| | 1700 | 19.7 | 33.0 | 25.0 | 20.2 | 2.1 |
| 4 | 0100 | 47.0 | 41.7 | 8.7 | 2.6 | 0 |
| | 0900 | 52.3 | 20.4 | 20.4 | 3.9 | 3.0 |
| | 1700 | 43.6 | 26.4 | 12.5 | 13.6 | 3.9 |
| 5 | 0100 | 26.0 | 37.3 | 23.6 | 10.8 | 2.3 |
| | 0900 | 27.2 | 30.5 | 23.4 | 18.5 | 0.4 |
| | 1700 | 37.8 | 50.1 | 9.1 | 1.5 | 1.5 |
| 6 | 0100 | 22.4 | 38.6 | 26.0 | 13.0 | 0 |
| | 0900 | 24.0 | 55.0 | 20.1 | 0.9 | 0 |
| | 1700 | 1.7 | 44.0 | 40.9 | 12.9 | 0.5 |
| 7 | 0100 | 24.3 | 38.3 | 24.3 | 11.6 | 1.5 |
| | 0900 | 1.2 | 20.6 | 35.4 | 35.4 | 7.4 |
| | 1700 | 35.1 | 29.1 | 16.3 | 16.3 | 3.2 |
| 8 | 0100 | 44.8 | 41.9 | 7.9 | 2.0 | 3.4 |
| | 0900 | 14.2 | 37.5 | 35.8 | 7.8 | 4.8 |
| | 1700 | 56.0 | 35.0 | 7.5 | 0.9 | 0.6 |
| Ave. | | 31.3 | 36.0 | 19.6 | 10.1 | 3.0 |

Table I-continued

| | | STONE GRADATION % Retained on Screed | | | | |
|---|---|---|---|---|---|---|
| Day | Time | 1-½" | 1" | ¾" | ½" | 0 |
| Deviation | | 16.6 | 10.3 | 9.8 | 8.6 | 4.2 |

As can be seen, the gradation of the limestone delivered from bin 12 varied tremendously with time, even though the mass density only ranged from 76 to 86 pounds per cubic foot.

Control valve 82 was calibrated such that the grate speed of grate 56 varied in response to a change in the density of the limestone passing through the burning zone between differential pressure sensors 74 and 78 as determined by changes in the differential pressure of fluid passing therethrough. The grate speed was correlated with each differential pressure increment within this range to yield a product which contained about 1.5 ± 1 wt. % of carbon dioxide and thereby yield a substantially uniform mass flow rate through the burning zone. It was specifically found that for a mass density range of from about 76 to about 86 pounds per cubic foot, a corresponding differential pressure range of about 7 inches of water would result. This differential pressure range was used to control the valve 82. In essence the average grate speed setting corresponded to a differential pressure of the fluid passing through the burning zone which would indicate that the mass density of the material therein was about 81 pounds per cubic foot; the fastest grate speed setting corresponded to a differential pressure which indicated the material had a mass density of about 76 pounds per cubic foot; and the slowest grate speed setting corresponded to a differential pressure which indicated that the mass density of the material passing through the burning zone was about 86 pounds per cubic foot.

Kiln 10 was initially set to operate with natural gas entering conduit 24 and air entering conduit 32 to establish a burning zone within the kiln of between 1500° and 2800° F, generally, between broken lines showing the lower end 20 and the upper end 22 thereof. This is accomplished by delivering air to conduit 32 and natural gas to conduit 24. The gas in conduit 24 was maintained at pressure of 29 psig by valve 23 and pressure controller 23*a*, and a temperature of about 80° F by heat exchanger 25. Furthermore, the fluid passing into the kiln comprised about 7,100 standard cubic feet per minute of air through fluid distributor 42 (flow controller 31*b* was set to close valve 31*a* and allow no gas to pass through conduit 31); a total of about 1,305 standard cubic feet per minute of a rich gas-air mixture which consisted of a ratio of about 4.9 standard cubic feet per minute of air to about 3 standard cubic feet of natural gas delivered through fuel distributor system 44; and about 2,755 standard cubic feet per minute of lean fuel-air mixture was passed through fluid distributor system 46 and consisted of a ratio of about 5.8 standard cubic feet of air to about 1 standard cubic foot of fuel. This resulted in excess air within the kiln of about 8.74 weight percent which in turn results in oxygen content of about 1.8 volume percent. Therefore, the set point of oxygen controller 37 was set to correspond to an oxygen content of about 1.8 volume percent in the effluent gases passing through stack 48. Thus, the output of oxygen controller 27, controlled air valve 36*d* to provide an air flow through conduit 36 in response to the oxygen content in the effluent gas passing through stack 48 to prevent excess oxygen from being supplied to the burning zone within the kiln.

After the instruments were calibrated, the limestone having the above-described gradation and having a density variation of between about 76 and about 86 pounds per cubic flow was passed to kiln 10 operating as set forth above, at a feed rate of about 22–24 tons per hour and the grate speed was controlled by level controller 18*a* such that a corresponding amount of calcined lime was removed from the kiln via outlet 50.

The kiln was operated for 32 hours and the average carbon dioxide content of the calcined limestone removed from outlet 50 (as determined by ASTM 25-29, Ascarite method) was about 1.5 weight percent, and it ranged from a low of about 0.5 weight percent to a high of about 2.0 weight percent.

As can be seen, the control approach which was utilized in accordance with the subject invention resulted in a substantial uniform product quality.

EXAMPLE 2

To more specifically illustrate the embodiment set forth in FIG. 4, particulate limestone such as described in Example 1 and having a mass density which ranges from about 76 to about 86 pounds per cubic foot is delivered to the internal shaft of vertical kiln 10 as set forth in FIG. 4 and subjected to heat treatment within the burning zone thereof operating at a temperature between 1,500° F and 2,800° F. The set point of oxygen controller 37 is set to control valve 36*b* and maintain an oxygen content within the effluent gases of stack 48 at about 1.8 volume %. Furthermore, flow controller 31*a* is set to close valve 31*b*. Valve 36*b* is normally open and allows about 64% by volume of total fluid passing into the interior of the burning zone to pass via fluid distributor 42. Furthermore, flow controllers 38*a* and 30*a* are set to maintain a ratio of 4.9 standard cubic feet of air to about 3 standard cubic feet of fuel delivered to fluid distributor 44 and to allow about 12% by volume of the total fluid delivered to the interior kiln to pass therethrough. Furthermore, flow controllers 28*a* and 40*a* are set to allow a ratio of about 5.8 standard cubic feet of air to about 1 standard cubic foot of fuel to pass to fluid distributor 46. These valves are set to allow about 24% by volume of the total fluid mixture passed to the burning zone within kiln 10 to pass through fluid distributor 46.

Natural gas is passed to conduit 24 and compressed air to conduit 32. Heat exchanger 25 maintains the temperature of the natural gas passing through conduit 24 at about 80° F and heat exchanger 33 maintains air passing through conduit 32 at about 130° F. Thus, at a constant temperature, the weight of fuel and air passing through valve 21 and 37, respectively, will vary directly with the square root of the change in the absolute pressure while maintaining a constant differential pressure across a metering orifice. Thus, the relative quantity of fuel and air passed through valves 21 and 37 respectively, can be easily controlled from the outputs of gas pressure controller 27 and air pressure controller 29 respectively. For example, where an average feed rate of about 25 to about 27 tons of limestone an hour being passed into hopper 18 and a corresponding constant volumetric withdrawal of the heat treated limestone via grate 56, differential pressure transmitter 72 is set with gas pressure controller 27 and air pressure controller 29 to regulate the quantity of natural gas and air passed into gas manifold 26 and air manifold 34 in a manner set forth below:

TABLE II

| MASS DENSITY OF STONE | TOTAL AIR (cubic feet per minute) | TOTAL GAS (cubic feet per minute) |
|---|---|---|
| 76 | 10,133 | 924 |
| 77 | 10,267 | 941 |
| 78 | 10,400 | 953 |
| 79 | 10,533 | 966 |
| 80 | 10,667 | 978 |
| 81 | 10,800 | 990 |
| 82 | 10,933 | 1002 |
| 83 | 11,067 | 1014 |
| 84 | 11,200 | 1027 |
| 85 | 11,333 | 1039 |
| 86 | 11,467 | 1051 |

The calcined product will be uniform and contain 1.5 ± 0.5 weight percent $CO_2$ therewithin.

It is to be noted that the subject invention can be utilized for control of any vertical kiln, furnace, retort, or the like, which is conventionally utilized to heat treat any particulate material. For example, the subject invention can be used not only for the calcining of lime but for the coking of coal, for burning argillaceous and calcareous material in the production of cement clinker, burning magnacite, dolomite, but also for retorting oil shale. Furthermore, the differential pressure control system of the subject invention can be utilized to not only control the flow of particulate material through the burning zone of a kiln, but can also be utilized to control the heat input to one or more heat treating zones within a vertical vessel. For example, the differential pressure transmitter 72 can be optionally connected to the valve controllers which control the position of one or more of the valves in the fuel-air system, e.g., valves 28*b*, 30*b*, 36*b*, 38*b*, and 40*b*, and as well as valves 21 and 37 when the differential pressure measurement indicates that material having a greater mass density than the average is entering the heat treating zone, differential pressure transmitter 72 can actuate the fuel-air control system to thereby supply a predetermined heat increase to the heat treating zone to thereby compensate for the greater mass density material. Likewise, when material of lower mass density than the average is passed to the heat treating zone, the fuel-air system can be proportionally cut back.

While this invention has been described in relation to its preferred embodiments, it is to be understood that various modifications thereof will now be apparent to one skilled in the art on reading this specification and it is intended to cover such modifications thereof will now be apparent to one skilled in the art on reading this specification and it is intended to cover such modifications as fall within the scope of the appended claims.

I claim:

1. In a process for heat treating particulate material of nonuniform gradation in a vertical vessel wherein the particulate material is passed to the particulate inlet at the upper end of the vessel causing the material to gravitate at a constant rate through a heat treating zone in the vertical vessel wherein it is contacted with upwardly moving heat treating fluid and thereafter removed from the particulate outlet at the lower end of said vessel, the improvement comprising:

sensing a quality indicative of the bulk density of said particulate material passing through said heat treating zone and regulating the heat input carried by said heat treating fluid to said heat treating zone in response to variations in the measured quality indicative of the bulk density of said particulate material passing through said heat treating zone to yield a product which has been heat treated equivalent to a charge of standard particles having a predetermined bulk density.

2. The process of claim 1 wherein said heat treating fluid comprises a combustible fuel-air mixture which is ignited and passed upwardly through said heat treating zone in said vessel.

3. The process of claim 2 wherein the relative quantity of fuel and air passed into said heat treating fluid is varied in response to variations in the measured quality indicative of bulk density of said particulate material passing through said heat treating zone.

4. The process of claim 2 wherein said fuel and said air are maintained at a relatively constant temperature respectively, before being ignited and passed into said heat treating zone.

5. The process of claim 3 wherein said particulate material is limestone.

6. The process of claim 3 wherein said particulate material is oil shale.

7. In a process for heat treating particulate material of nonuniform gradation in a vertical vessel wherein the particulate material is passed to the inlet of the vertical vessel causing the material to gravitate at a constant rate through a heat treating zone in the vessel wherein it is contacted with upwardly moving heat treating fluid, and thereafter removed from the particulate outlet at the lower end of the vessel, the improvement comprising:

measuring the distance in pressure between said fluid passing to said heat treating zone and said fluid passing from said heat treating zone to determine the relative bulk density of said particulate material passing through said heat treating zone and regulating the heat input carried by said heat treating fluid to said heat treating zone in response to variations in the measured differential pressure of said fluid passing into and from said heat treating zone to yield a product which has been heat treated equivalent to a charge of standard particles having a predetermined bulk density.

8. The process of claim 7 wherein said heat treating fluid comprises a combustible fuel-air mixture which is ignited and passed upwardly through said heat treating zone in said vessel.

9. The process of claim 8 wherein the relative quantity of fuel and air passed into said heat treating fluid is varied in response to variations in the measured quality indicative of bulk density of said particulate material passing through said heat treating zone.

10. The process of claim 8 wherein said fuel and said air are maintained at a relatively constant temperature respectively, before being ignited and passed into said heat treating zone.

11. The process of claim 9 wherein said particulate material is limestone.

12. The process of claim 9 wherein said particulate material is oil shale.

13. A vertical vessel for heat treating particulate material comprising:

a. an elongated heating chamber having an upper inlet end and a lower outlet end and at least one heat treating zone therebetween;

b. means for supplying a heating fluid to the interior of said elongated vertical heating chamber to thereby pass upwardly through said heat treating zone;

c. grate means positioned in the outlet of said vessel for removing heat treated particulate material therefrom at a constant controlled rate;

d. means to measure the pressure of said heating fluid passing into a particulate mass in said heat treating zone and means to measure the pressure of said heating fluid passing from a particulate mass in said heat treating zone, and means for obtaining a differential pressure therebetween; and e. means operatively connected to said means for obtaining a differential pressure for regulating the heat content of said heating fluid in response to fluctuations in said differential pressure.

14. The vertical heat treating vessel of claim 13 wherein said means for supplying heating fluid comprises a means for supplying a fuel-air combustion supporting fluid to the interior of said heat treating zone.

15. The vertical heat treating vessel of claim 14 further comprising means to supply particulate material to the inlet of said elongated vertical heating chamber to maintain a constant level of particulate material therewithin.

* * * * *

UNITED STATES PATENT OFFICE

CERTIFICATE OF CORRECTION

Patent No. 4,002,421 Dated January 11, 1977

Inventor(s) James R. Summer

It is certified that error appears in the above-identified patent and that said Letters Patent are hereby corrected as shown below:

Column 2, lines 6 and 7, "3/4 or less to about 2 3/4 inches or more" should read -- 3/4" or less to about 2-3/4 or more --.

Column 5, line 1, "product" should read -- produce --.

Column 11, line 59, "average" should read --"average" --.

line 64, "average" should read -- "average" --.

Column 12, line 26, "average" should read --"average" --.

Column 13, line 34, "3/4 to about 2 3/4 or more" should read -- 3/4 to about 2-3/4 inches. --.

Column 14, line 28, Column 16, line 41 and 47, "average", each occurrence, should read -- "average" --.

Column 17, line 37, "distance" should read -- difference --.

Signed and Sealed this twelfth Day of July 1977

[SEAL]

Attest:

RUTH C. MASON
Attesting Officer

C. MARSHALL DANN
Commissioner of Patents and Trademarks